US009865386B2

(12) United States Patent
Takagi et al.

(10) Patent No.: US 9,865,386 B2
(45) Date of Patent: Jan. 9, 2018

(54) COIL COMPONENT AND CIRCUIT BOARD HAVING THE SAME

(71) Applicant: TDK Corporation, Tokyo (JP)

(72) Inventors: Nobuo Takagi, Tokyo (JP); Kouyu Ohi, Yamagata (JP); Tasuku Mikogami, Tokyo (JP); Setu Tsuchida, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 15/395,099

(22) Filed: Dec. 30, 2016

(65) Prior Publication Data

US 2017/0194085 A1 Jul. 6, 2017

(30) Foreign Application Priority Data

Jan. 5, 2016 (JP) ..... 2016-000325

(51) Int. Cl.
*H01F 27/29* (2006.01)
*H01F 27/06* (2006.01)
*H01F 3/10* (2006.01)

(52) U.S. Cl.
CPC ..... *H01F 27/06* (2013.01); *H01F 27/29* (2013.01); *H01F 27/292* (2013.01); *H01F 3/10* (2013.01); *H01F 2027/065* (2013.01)

(58) Field of Classification Search
CPC ..... H01F 5/00; H01F 27/00–27/36
USPC ..... 336/65, 83, 192, 200, 220–223, 232
See application file for complete search history.

(56) References Cited

U.S. PATENT DOCUMENTS 8,686,822 B2 * 4/2014 Huang ..... H01F 27/292 336/170
9,196,415 B2 * 11/2015 Takagi ..... H01F 27/29
2008/0309445 A1 * 12/2008 Suzuki ..... H01F 27/2823 336/183
2010/0109827 A1 * 5/2010 Asou ..... H01F 17/045 336/192
2012/0133469 A1 * 5/2012 Tomonari ..... H01F 3/14 336/192
2013/0049914 A1 * 2/2013 Huang ..... H01F 27/292 336/192
2014/0292463 A1 10/2014 Lai

FOREIGN PATENT DOCUMENTS

JP 2014199906 A 10/2014

* cited by examiner

*Primary Examiner* — Tuyen Nguyen
(74) *Attorney, Agent, or Firm* — Young Law Firm, P.C.

(57) ABSTRACT

Disclosed herein is a coil component that includes a drum-shaped core having a first flange part provided at one end of a winding core part, first to fourth terminal metal fittings formed on the first flange part so as to be arranged in this order in a second direction, and first to fourth wires wound around the winding core part. One ends of the first to fourth wires are connected to different ones of the first to fourth terminal metal fittings. A distance between the first and second terminal metal fittings is larger than the distance between the third and fourth terminal metal fittings. An amount of an adhesive used to bond each of the third and fourth terminal metal fittings is greater than an amount of an adhesive used to bond each of the first and second metal fittings.

7 Claims, 9 Drawing Sheets

COIL COMPONENT AND CIRCUIT BOARD HAVING THE SAME

BACKGROUND OF THE INVENTION

Field of the Invention

The present invention relates to a coil component and a circuit board having the same and, more particularly, to a coil component using a drum-shaped core and a circuit board having the same.

Description of Related Art

In recent years, electronic components used for an information terminal such as a smartphone are strongly required to reduce the size and particularly height thereof. Thus, a large number of surface-mount type coil components not using a toroidal-shaped core but using a drum-shaped core exist as a coil component such as a pulse transformer. For example, Japanese Patent Application Laid-Open No. 2014-199906 discloses a surface-mount type pulse transformer using a drum-shaped core.

The drum-shaped core of the pulse transformer descried in Japanese Patent Application Laid-Open No. 2014-199906 has a configuration in which the mounting surface at the flange thereof has a concave-convex shape and the end portion of a wire is connected onto the convex part, as illustrated in FIG. 2 of Japanese Patent Application Laid-Open No. 2014-199906. On the other hand, a terminal electrode is not formed on the outer surface of the flange. With such a configuration, when the pulse transformer described in Japanese Patent Application Laid-Open No. 2014-199906 is mounted on a printed circuit board, a solder is formed between a land pattern on the printed circuit board and the convex part of the flange. Since the terminal electrode is not formed on the outer surface of the flange, a solder fillet is not formed on the outer surface.

In recent years, particularly, an on-vehicle coil component is required to have higher reliability than ever before. To meet this requirement, it is important to form a solder fillet when the coil component is mounted. A method that bonds a terminal metal fitting to the outer surface of a flange can be used in order to form a solder fillet; however, bonding strength of the terminal metal fitting may be lowered due to heat applied when the wire is connected to the terminal metal fitting.

SUMMARY

An object of the present invention is therefore to provide a coil component in which bonding strength of the terminal metal fitting bonded to the outer surface of the flange thereof is sufficiently secured and a circuit board having the coil component.

A coil component according to the present invention includes:

a drum-shaped core including:

a winding core part, an axial direction of the winding core part being a first direction;

a first flange part provided at one end of the winding core part in the first direction; and a second flange part provided at other end of the winding core part in the first direction;

first to fourth terminal metal fittings bonded to the first flange part so as to be arranged in this order in a second direction substantially perpendicular to the first direction;

fifth to eighth terminal metal fittings bonded to the second flange part so as to be arranged in this order in the second direction; and first to fourth wires wound around the winding core part, one ends of the first to fourth wires being connected to different ones of the first to fourth terminal metal fittings and other ends of the first to fourth wires being connected to different ones of the fifth to eighth terminal metal fittings, wherein the first flange part has a first inner side surface connected to the winding core part and a first outer side surface opposite to the first inner side surface, the second flange part has a second inner side surface connected to the winding core part and a second outer side surface opposite to the second inner side surface, the first to fourth terminal metal fittings are bonded at least to the first outer side surface, the fifth to eighth terminal metal fittings are bonded at least to the second outer side surface, a distance between the first and second terminal metal fittings in the second direction is larger than the distance between the third and fourth terminal metal fittings in the second direction, a distance between the fifth and sixth terminal metal fittings in the second direction is larger than the distance between the seventh and eighth terminal metal fittings in the second direction, and an amount of an adhesive used to bond each of the third, fourth, seventh, and eighth terminal metal fittings is greater than an amount of an adhesive used to bond each of the first, second, fifth, and sixth terminal metal fittings.

A circuit board according to the present invention includes: a substrate having a plurality of land patterns; the coil component mounted on the substrate; and solders that connect the plurality of land patterns and the first to eighth terminal metal fittings. The plurality of land patterns include first, second, third, and fourth land patterns connected respectively to the first, second, fifth, and sixth terminal metal fittings, a fifth land pattern connected in common to the third and fourth terminal metal fittings, and a sixth land pattern connected in common to the seventh and eighth terminal metal fittings.

According to the present invention, the amount of an adhesive for use in bonding the third, fourth, seventh, and eighth terminal metal fittings is increased, so that it is possible to prevent a decrease in bonding strength caused by heat which is likely to be accumulated owing to the small distance between terminal metal fittings. In addition, a sufficient distance is ensured between the first and second terminal metal fittings (or distance between the fifth and sixth terminal metal fittings), so that even when these terminal metal fittings are connected to mutually different land patterns, occurrence of a short circuit fault can be prevented. Further, the distance between the third and fourth terminal metal fittings (distance between the seventh and eighth terminal metal fittings) is small, so that when these terminal metal fittings are used as a center tap of a pulse transformer, they can be reliably short-circuited by a bridge of the solder.

Preferably, in the present invention, each of the first to eighth terminal metal fittings has a bonding surface facing the first or second flange part and a side surface substantially perpendicular to the bonding surface, and the adhesive for use in bonding the third, fourth, seventh, and eighth terminal metal fittings covers at least a part of each of the side surfaces of the third, fourth, seventh, and eighth terminal metal fittings. With this configuration, bonding strength of the third, fourth, seventh, and eighth terminal metal fittings can be enhanced.

Preferably, in the present invention, the first flange part further has a first bottom surface substantially parallel to the first and second directions, the second flange part further has a second bottom surface substantially parallel to the first and second directions, each of the first to fourth terminal metal fittings has an L-shaped so as to cover the first outer surface and the first bottom surface, each of the fifth to eighth terminal metal fittings has an L-shaped so as to cover the second outer surface and the second bottom surface, the one end of each of the first to fourth wires contacts with each of the first to fourth terminal metal fittings on the first bottom surface, and the other end of each of the first to fourth wires contacts with each of the fifth to eighth terminal metal fittings on the second bottom surface. With this configuration, wire connection can be easily achieved.

Preferably, in the present invention, the coil component further has a plate core, wherein the first flange part further has a first top surface opposite to the first bottom surface, the second flange part further has a second top surface opposite to the second bottom surface, and the plate core is bonded to the first and second top surfaces. With this configuration, high magnetic characteristics can be obtained.

Preferably, in the present invention, the first to eighth terminal metal fittings do not overlap the winding core part as viewed in the first direction. With this configuration, eddy current loss can be reduced.

According to the present invention, a decrease in bonding strength of the terminal metal fittings due to heat can be prevented, so that it is possible to provide a coil component having high reliability and a circuit board having the coil component.

BRIEF DESCRIPTION OF THE DRAWINGS

The above and other objects, features and advantages of this invention will become more apparent by reference to the following detailed description of the invention taken in conjunction with the accompanying drawings, wherein.

DETAILED DESCRIPTION OF THE EMBODIMENTS

Preferred embodiments of the present invention will now be explained in detail with reference to the drawings.

Figure 1:
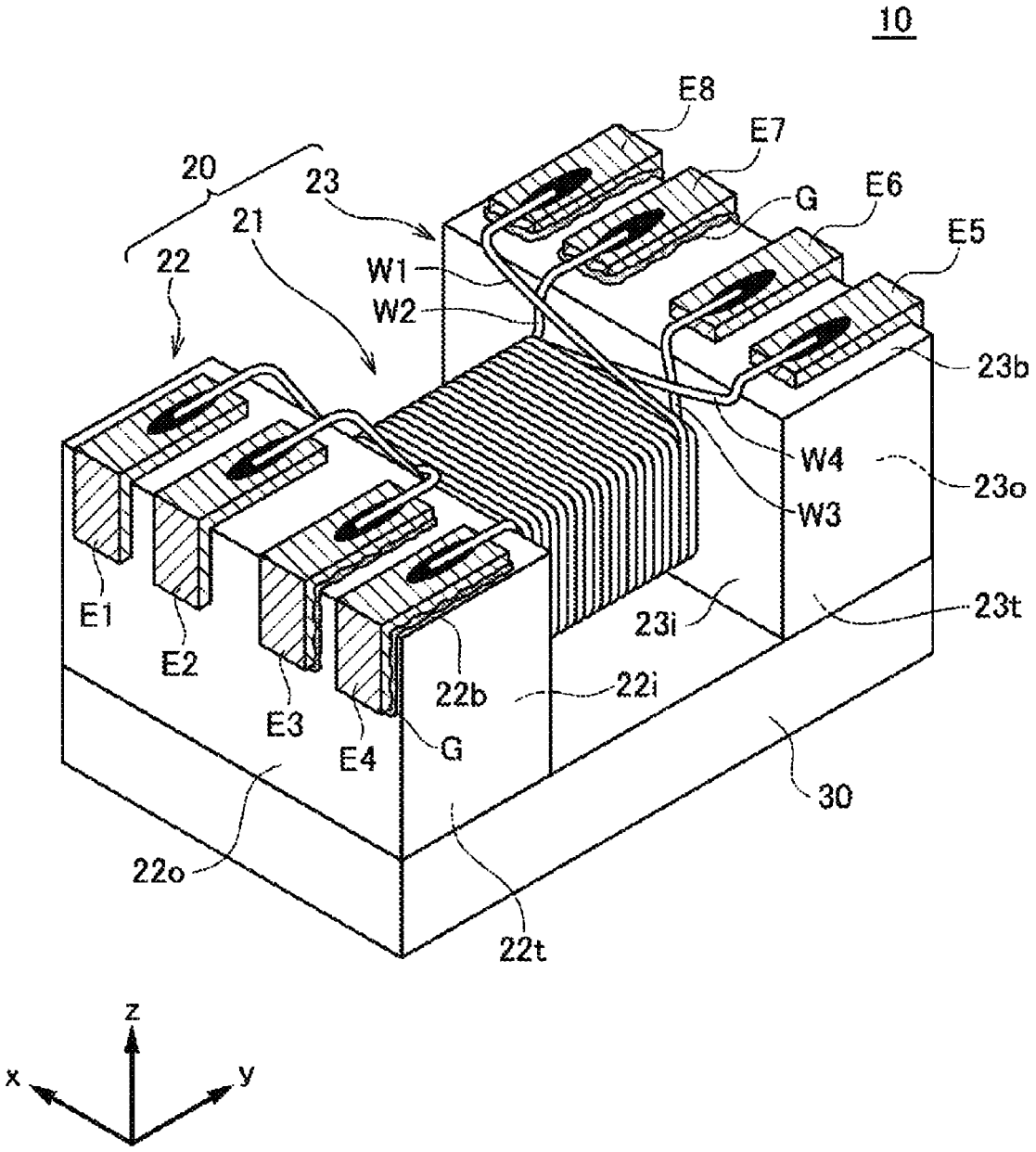
FIG. 1 is a schematic perspective view illustrating an external structure of a coil component according to a preferred embodiment of the present invention.

FIG. 1 is a schematic perspective view illustrating an external structure of a coil component 10 according to a preferred embodiment of the present invention.

The coil component 10 according to the present embodiment is a surface-mount type pulse transformer. As illustrated in FIG. 1, the coil component 10 includes a drum-shaped core 20, a plate core 30 bonded to the drum-shaped core 20, and wires W1 to W4 wound around a winding core part 21 of the drum-shaped core 20. The coil component according to the present invention is not limited to a pulse transformer, but may be other transformer components such as a balun transformer and a booster transformer or filter components such as a common mode choke coil.

The drum-shaped core 20 and the plate core 30 are formed of a magnetic material having comparatively high permeability, such as a sintered body of a Ni—Zn ferrite or Mn—Zn ferrite. In general, a magnetic material having high permeability, such as Mn—Zn ferrite, is low in specific resistance and has conductivity.

The drum-shaped core 20 has a rod-like winding core part 21 whose axial direction is the y-direction, and first and second flange parts 22 and 23 provided at both ends of the winding core part 21 in the y-direction. The winding core part 21 and flange parts 22 and 23 are integrally formed. The flange part 22 has an inner side surface 22*i* connected to the winding core part 21, an outer side surface 22*o* positioned on the opposite side of the inner side surface 22*i*, a bottom surface 22*b* extending parallel to the axial direction of the winding core part 21, and a top surface 22*t* positioned on the opposite side of the bottom surface 22*b*. Similarly, the flange part 23 has an inner side surface 23*i* connected to the winding core part 21, an outer side surface 23*o* positioned on the opposite side of the inner side surface 23*i*, a bottom surface 23*b* extending parallel to the axial direction of the winding core part 21, and a top surface 23*t* positioned on the opposite side of the bottom surface 23*b*. The inner side surfaces 22*i* and 23*i* and the outer side surfaces 22*o* and 23*o* constitute the xz plane, and bottom surfaces 22*b* and 23*b* and the top surfaces 22*t* and 23*t* constitute the xy plane.

The coil component 10 is a component surface-mounted on a printed circuit board at actual use time and is mounted with bottom surfaces 22*b* and 23*b* of the respective flange parts 22 and 23 facing the printed circuit board. The plate core 30 is bonded by adhesive to the top surfaces 22*t* and 23*t* of the respective flange parts 22 and 23. With such a configuration, the drum-shaped core 20 and the plate core 30 constitute a closed magnetic path.

As illustrated in FIG. 1, first to fourth terminal metal fittings E1 to E4 are arranged in this order in the x-direction on the bottom surface 22*b* and outer side surface 22*o* of the flange part 22, and the fifth to eighth terminal metal fittings E5 to E8 are arranged in this order in the x-direction on the bottom surface 23*b* and outer side surface 23*o* of the flange part 23. The terminal metal fittings E1 to E8 have an L-shape and bonded to the flange part 22 or 23 through an adhesive. By using the L-shaped terminal metal fitting, it is possible to reduce production cost as compared with a case where the terminal electrode is formed by baking metal paste thereonto.

The amount of an adhesive G used to bond the terminal metal fittings E1 to E8 is larger for each of the terminal metal fittings E3, E4, E7, and E8 than for each of the terminal metal fittings E1, E2, E5, and E6. This is because, as described later, a higher heat load is applied at wire connection to each of the terminal metal fittings E3, E4, E7, and E8 than to each of the terminal metal fittings E1, E2, E5, and E6, which may lower bonding strength of each of the terminal metal fittings E3, E4, E7, and E8. Since the amount of the adhesive G used for each of the terminal metal fittings E3, E4, E7, and E8 is larger, apart of the adhesive G protrudes from between each of the terminal metal fittings E3, E4, E7, and E8 and the flange part 22 or 23 to cover the side surfaces of each of the terminal metal fittings E3, E4, E7, and E8.

The four wires W1 to W4 are wound around the winding core part 21. One ends of the wires W1 to W4 are connected to different ones of the terminal metal fittings E1 to E4, and the other ends of the wires W1 to W4 are connected to different ones of the terminal metal fittings E5 to E8. The wires W1 to W4 are each connected to a part of the terminal metal fitting that covers the bottom surface 22*b* or 23*b*. The connection method will be described later.

Although not especially limited, the wire W1 is connected to the terminal metal fittings E1 and E8, and the winding direction thereof is, e.g., clockwise. The wire W2 is connected to the terminal metal fittings E2 and E7, and the winding direction thereof is, e.g., counterclockwise. The wire W3 is connected to the terminal metal fittings E3 and E6, and the winding direction thereof is, e.g., clockwise. The wire W4 is connected to the terminal metal fittings E4 and E5, and the winding direction thereof is, e.g., counterclockwise.

Figure 2:
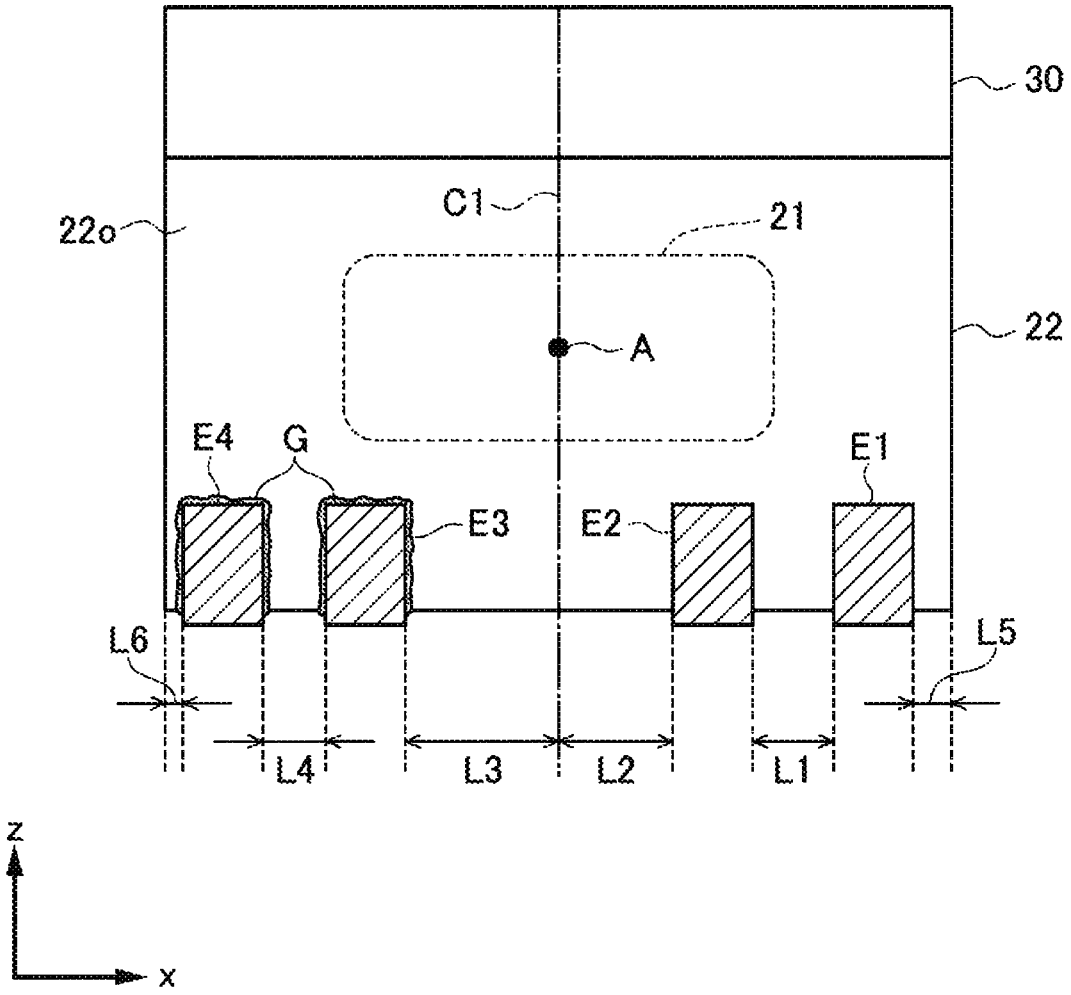
FIGS. 2 and 3 are side views of the coil component shown in FIG. 1 as seen from the y-direction.
Figure 3:
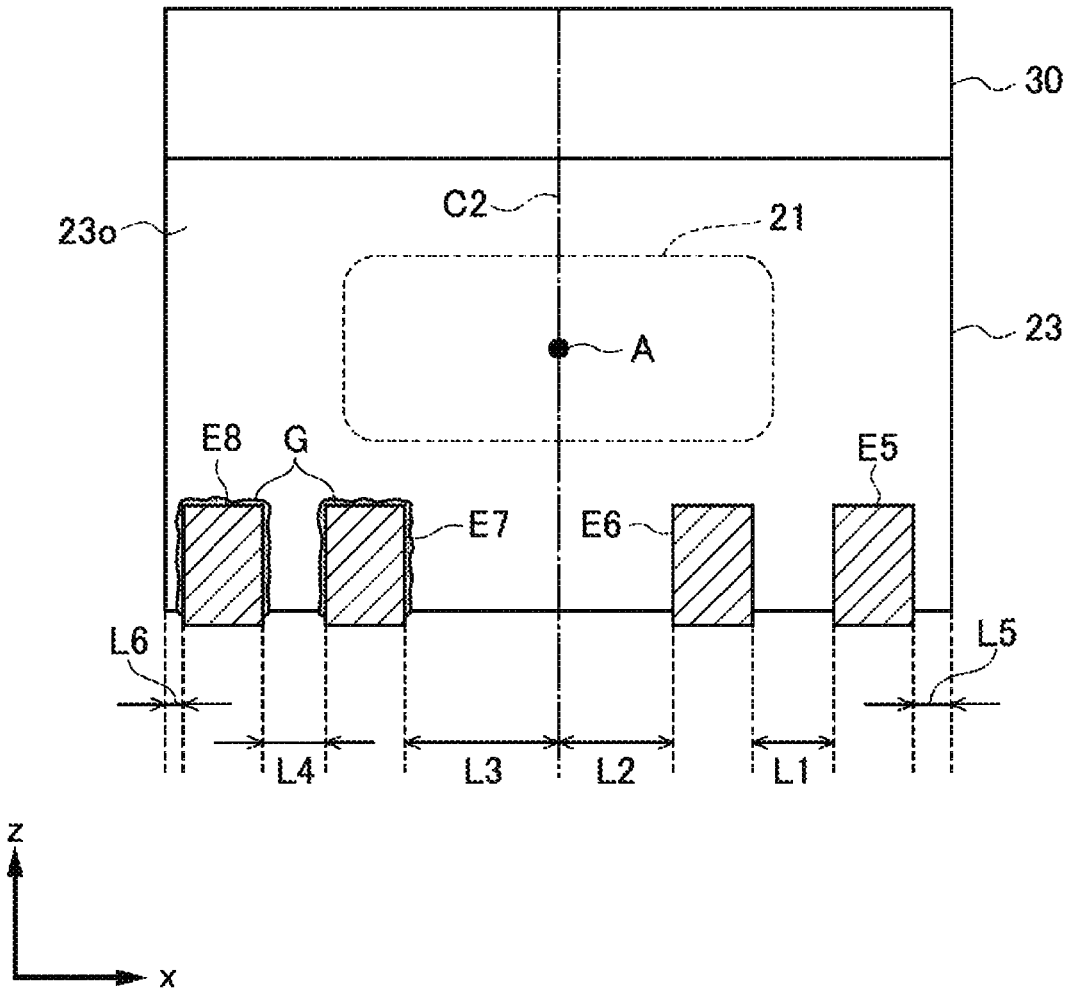

FIGS. 2 and 3 are each a side view of the coil component 10 as seen from the y-direction. More specifically, FIG. 2 is a view as observed from the flange part 22 side, and FIG. 3 is a view as observed from the flange part 23 side.

FIG. 2 illustrates in detail the layout of the terminal metal fittings E1 to E4. Assuming that the distance between the terminal metal fittings E1 and E2 in the x-direction is L1 and that the distance between the terminal metal fittings E3 and E4 in the x-direction is L4, the coil component 10 according to the present embodiment satisfies L1>L4.

Assume that a virtual line C1 that passes a center axis A of the winding core part 21 and extends in the z-direction is defined on the outer side surface 22*o*. In this case, assuming that the distance between the virtual line C1 and the terminal metal fitting E2 in the x-direction is L2, and the distance between the virtual line C1 and the terminal metal fitting E3 in the x-direction is L3, the coil component 10 according to the present embodiment satisfies L2<L3. Further, L1<L2+L3 is satisfied.

Further, the distance between an x-direction right side end portion of the outer side surface 22*o* and the terminal metal fitting E1 in the x-direction is L5, and the distance between an x-direction left side end portion of the outer side surface 22*o* and the terminal metal fitting E4 in the x-direction is L6, the coil component 10 according to the present embodiment satisfies L5>L6.

Further, each of the terminal metal fittings E1 to E4 is designed short in z-direction length so as not to overlap the winding core part 21 as viewed from the y-direction.

As described above, a part of the adhesive G for bonding each of the terminal metal fittings E3 and E4 protrudes to the side surfaces of each of the terminal metal fittings E3 and E4.

FIG. 3 illustrates in detail the layout of the terminal metal fittings E5 to E8. Assuming that the distance between the terminal metal fittings E5 and E6 in the x-direction is L1 and that the distance between the terminal metal fittings E7 and E8 in the x-direction is L4, the coil component 10 according to the present embodiment satisfies L1>L4.

Assume that a virtual line C2 that passes the center axis A of the winding core part 21 and extends in the z-direction is defined on the outer side surface 23*o*. In this case, assuming that the distance between the virtual line C2 and the terminal metal fitting E6 in the x-direction is L2, and the distance between the virtual line C2 and the terminal metal fitting E7 in the x-direction is L3, the coil component 10 according to the present embodiment satisfies L2<L3. Further, L1<L2+L3 is satisfied.

Further, the distance between an x-direction right side end portion of the outer side surface 23*o* and the terminal metal fitting E5 in the x-direction is L5, and the distance between an x-direction left side end portion of the outer side surface 23*o* and the terminal metal fitting E8 in the x-direction is L6, the coil component 10 according to the present embodiment satisfies L5>L6.

Further, each of the terminal metal fittings E5 to E8 is designed short in z-direction length so as not to overlap the winding core part 21 as viewed from the y-direction.

As described above, a part of the adhesive G for bonding each of the terminal metal fittings E7 and E8 protrudes to the side surfaces of each of the terminal metal fittings E7 and E8.

In the present embodiment, the terminal metal fittings E1 to E8 are arranged in the above-described layout, so that when, for example, the terminal metal fittings E1 and E2 are used as a primary side input/output terminal of the pulse transformer, the terminal metal fittings E5 and E6 are used as a secondary side input/output terminal of the pulse transformer, the terminal metal fittings E7 and E8 are used as a primary side center tap of the pulse transformer, and the terminal metal fittings E3 and E4 are used as a secondary side center tap, it is possible to reduce eddy current loss while ensuring the withstand voltage between the primary and secondary sides. The withstand voltage between the primary and secondary sides can be ensured by increasing the distance (L2+L3) with respect to the distance L1 or L2.

The eddy current is generated when a magnetic flux caused by current flowing in the wires W1 to W4 crosses the terminal metal fittings E1 to E8. The coil component 10 according to the present embodiment is laid out such that the terminal metal fittings E1 to E8 do not overlap the winding core part 21 as viewed in the y-direction, so that occurrence of the eddy current can be suppressed.

In order to suppress occurrence of the eddy current as much as possible in the configuration where terminal metal fittings E1 to E8 do not overlap the winding core part 21 as viewed in the y-direction, the planar positions of the terminal metal fittings E1 to E8 as viewed from the y-direction should preferably be separate from the center axis A of the winding core part 21 as much as possible. This configuration is achieved by, for example, disposing the terminal metal fittings E1 and E2 as close to the right side of FIG. 2 as possible, and the terminal metal fittings E3 and E4 as close to the left side of FIG. 2 as possible. However, when the terminal metal fittings E1 and E2 are used respectively as the primary side input/output terminals of the pulse transformer, if the distance L1 between them is made excessively small, the primary side input/output terminal pair may be short-circuited. Thus, it is necessary to ensure a certain size for the distance L1 between the terminal metal fittings E1 and E2.

On the other hand, when being used as the secondary side center taps of the pulse transformer, the terminal metal fittings E3 and E4 are applied with the same potential. Thus, the distance L4 between the terminal metal fittings E3 and E4 can be smaller than the distance L1 (L1>L4). As a result, the terminal metal fitting E3 can be offset more outward than the terminal metal fitting E2 (L3>L2). This allows the distance between the terminal metal fittings E3, E4 and the center axis A of the winding core part 21 to be large, so that it is possible to reduce eddy current generated in the terminal metal fittings E3 and E4.

In addition, when the terminal metal fittings E3 and E4 are used as the secondary side center taps of the pulse transformer, they have the same potential. Thus, the terminal metal fittings E3 and E4 have a higher degree of freedom in layout design than the terminal metal fittings E1 and E2. By utilizing this point, the terminal metal fitting E4 is disposed closer to the end portion (L5>L6) in the present embodiment, thereby enabling further reduction of eddy current generated in the terminal metal fittings E3 and E4.

The same is applied to the terminal metal fittings E5 to E8. That is, the terminal metal fitting E7 is offset more outward than the terminal metal fitting E6, enabling reduction of eddy current generated in the terminal metal fittings E7 and E8. In addition, the terminal metal fitting E8 is disposed closer to the end portion, thereby enabling further reduction of eddy current generated in the terminal metal fittings E7 and E8.

Figure 4:
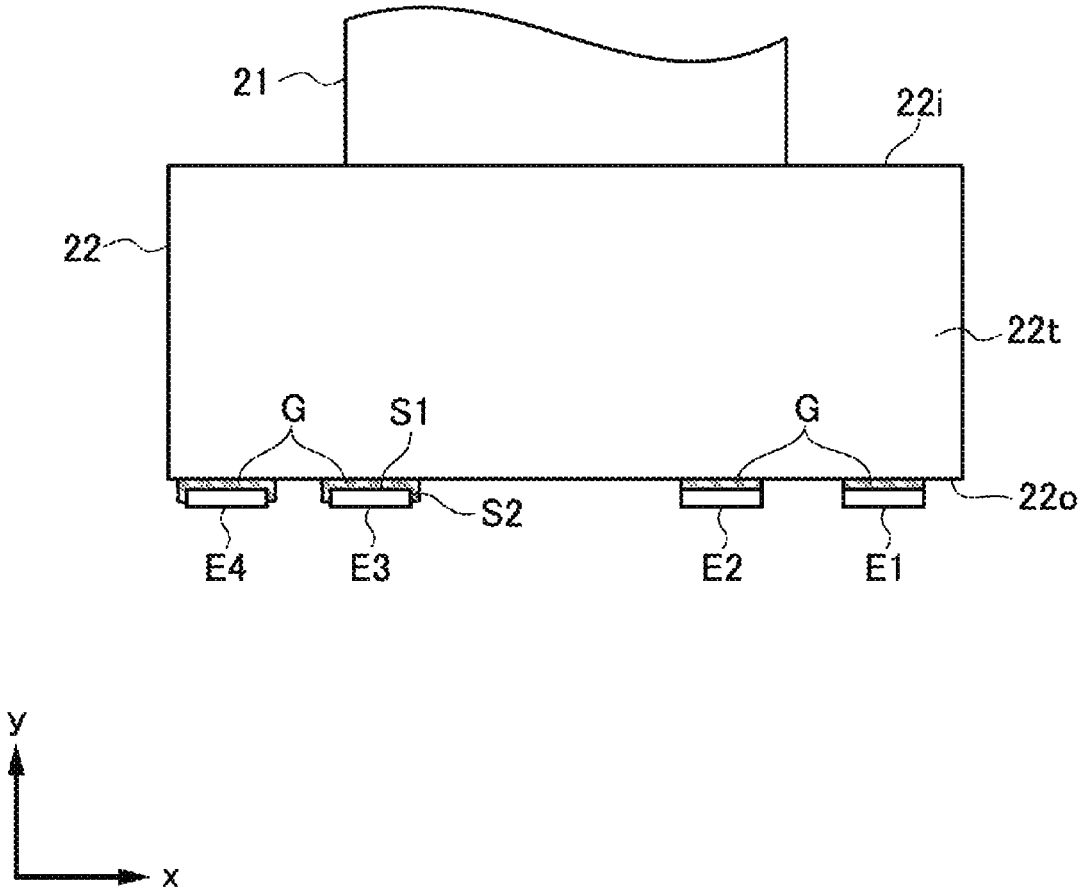
FIG. 4 is a top view illustrating a top surface of a flange part as viewed in the z-direction.

FIG. 4 is a top view illustrating the top surface 22*t* of the flange part 22 as viewed in the z-direction.

As illustrated in FIG. 4, the terminal metal fittings E1 to E4 are bonded to the outer side surface 22*o* of the flange part 22 through the adhesive G, and the amount of the adhesive G used for each of the terminal metal fittings E3 and E4 is larger than for each of the terminal metal fittings E1 and E2. Specifically, assume that the XZ plane of each of the terminal metal fittings E1 to E4 that is opposite to the outer side surface 22*o* of the flange 22 is defined as a bonding surface S1 and that the yz plane thereof that is perpendicular to the bonding surface S1 is as a side surface S2. In this case, in the terminal metal fittings E1 and E2, the adhesive G covers only the bonding surface S1; while in the terminal metal fittings E3 and E4, the adhesive G covers not only the bonding surface S1, but also at least apart of the side surface S2. This increases bonding strength of the terminal metal fittings E3 and E4.

Although not illustrated, the same is applied to the terminal metal fittings E5 to E8. That is, in the terminal metal fittings E5 and E6, the adhesive G covers only the bonding surface S1; while in the terminal metal fittings E7 and E8, the adhesive G covers not only the bonding surface S1, but also at least a part of the side surface S2.

The reason for increasing bonding strength of the terminal metal fittings E3 and E4 (E7 and E8) is as follows.

Figure 5A:
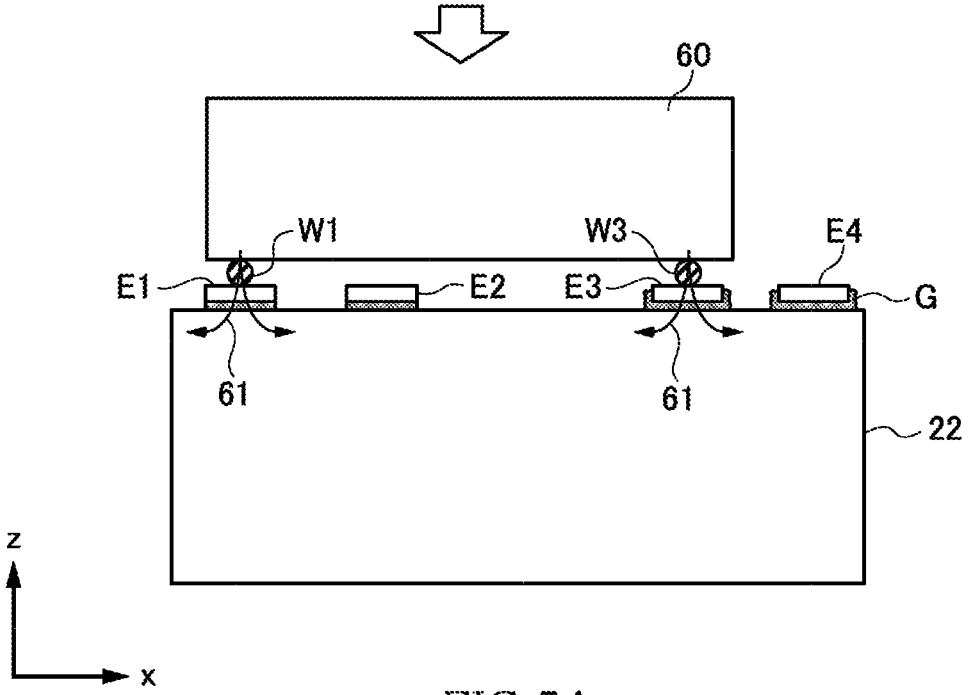
FIGS. 5A and 5B are xz cross-sectional views of the flange part.
Figure 5B:
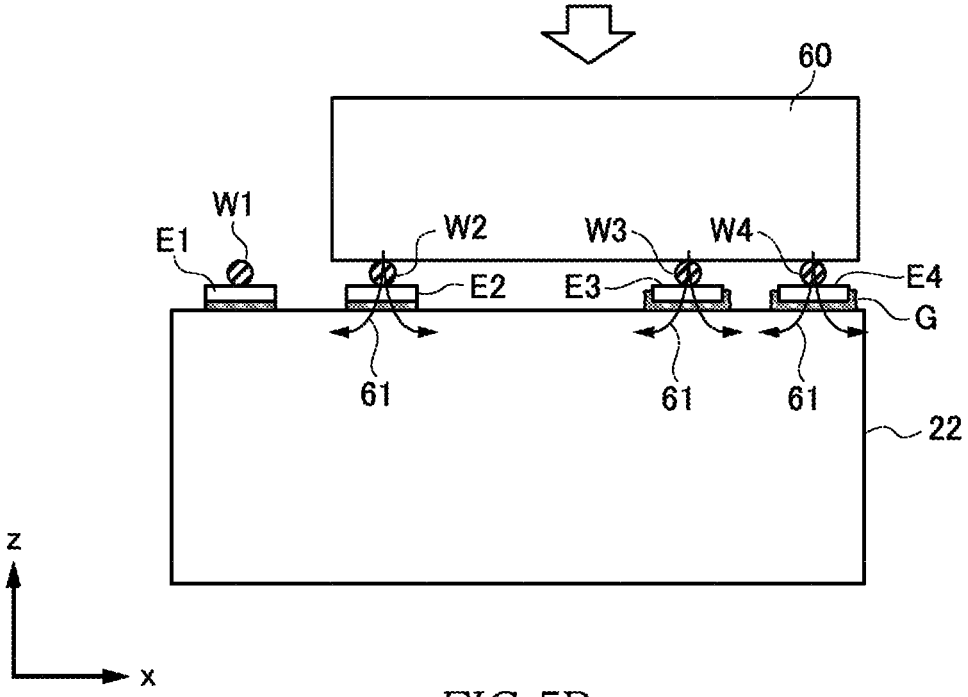

FIGS. 5A and 5B are xz cross-sectional views of the flange part 22. FIG. 5A illustrates a process of connecting the wires W1 and W3 to the terminal metal fittings E1 and E3, respectively. FIG. 5B illustrates a process of connecting the wires W2 and W4 to the terminal metal fittings E2 and E4, respectively.

First, as illustrated in FIG. 5A, the wires W1 and W3 are positioned onto the surfaces of the respective terminal metal fittings E1 and E3, and then a heater head 60 is lowered in the z-direction to be pressed against the wires W1 and W3. As a result, the wires W1 and W3 are thermocompression bonded to the terminal metal fittings E1 and E3, respectively. At this time, heat 61 from the heater head 60 is transmitted to the flange part 22 to heat the vicinities of the terminal metal fittings E1 and E3.

Next, as illustrated in FIG. 5B, the wires W2 and W4 are positioned onto the surfaces of the respective terminal metal fittings E2 and E4, and then the heater head 60 whose x-direction position has been shifted is lowered in the z-direction to be pressed against the wires W2 and W4. As a result, the wires W2 and W4 are thermocompression bonded to the terminal metal fittings E2 and E4, respectively, and the heat 61 from the heater head 60 is transmitted again to the flange part 22. At this time, the thermocompression bonded wire W3 already exists on the surface of the terminal metal fitting E3, so that the vicinities of the terminal metal fittings E2, E3, and E4 are heated.

That is, the terminal metal fittings E1, E2, and E4 are heated by the heater head 60 only once; while the terminal metal fitting E3 is heated twice. Thus, as compared to the amount of heat applied to the terminal metal fittings E1, E2 and E4, more heat is accumulated in the vicinity of the terminal metal fitting E3. In addition, as described above, the distance (L4) between the terminal metal fittings E3 and E4 in the x-direction is set small, so that the accumulated heat has an influence on the terminal metal fitting E4.

As a result, in the wire connection process, a larger thermal load is applied to the adhesive G for each of the terminal metal fittings E3 and E4 than to the adhesive G for terminal metal fittings E1 and E2, which may lower bonding strength of the terminal metal fittings E3 and E4. Considering this point, in the coil component 10 according to the present embodiment, the amount of the adhesive G used for the terminal metal fittings E3 and E4 is increased to enhance bonding strength thereof. Thus, if a part of the adhesive G corresponding to the terminal metal fitting E3 that is heated twice is deteriorated by heat, bonding strength can be ensured by the residual adhesive G that has not yet been deteriorated.

The same is applied to a case where the wires W1 to W4 are connected respectively to the terminal metal fittings E5 to E8. That is, the terminal metal fittings E5, E6, and E8 are heated by the heater head 60 only once; while the terminal metal fitting E7 is heated twice. However, in the coil component 10 according to the present embodiment, the amount of the adhesive G used for the terminal metal fittings E7 and E8 is increased, so that bonding strength thereof can be enhanced.

This is the structure of the coil component 10 according to the present embodiment.

Figure 6:
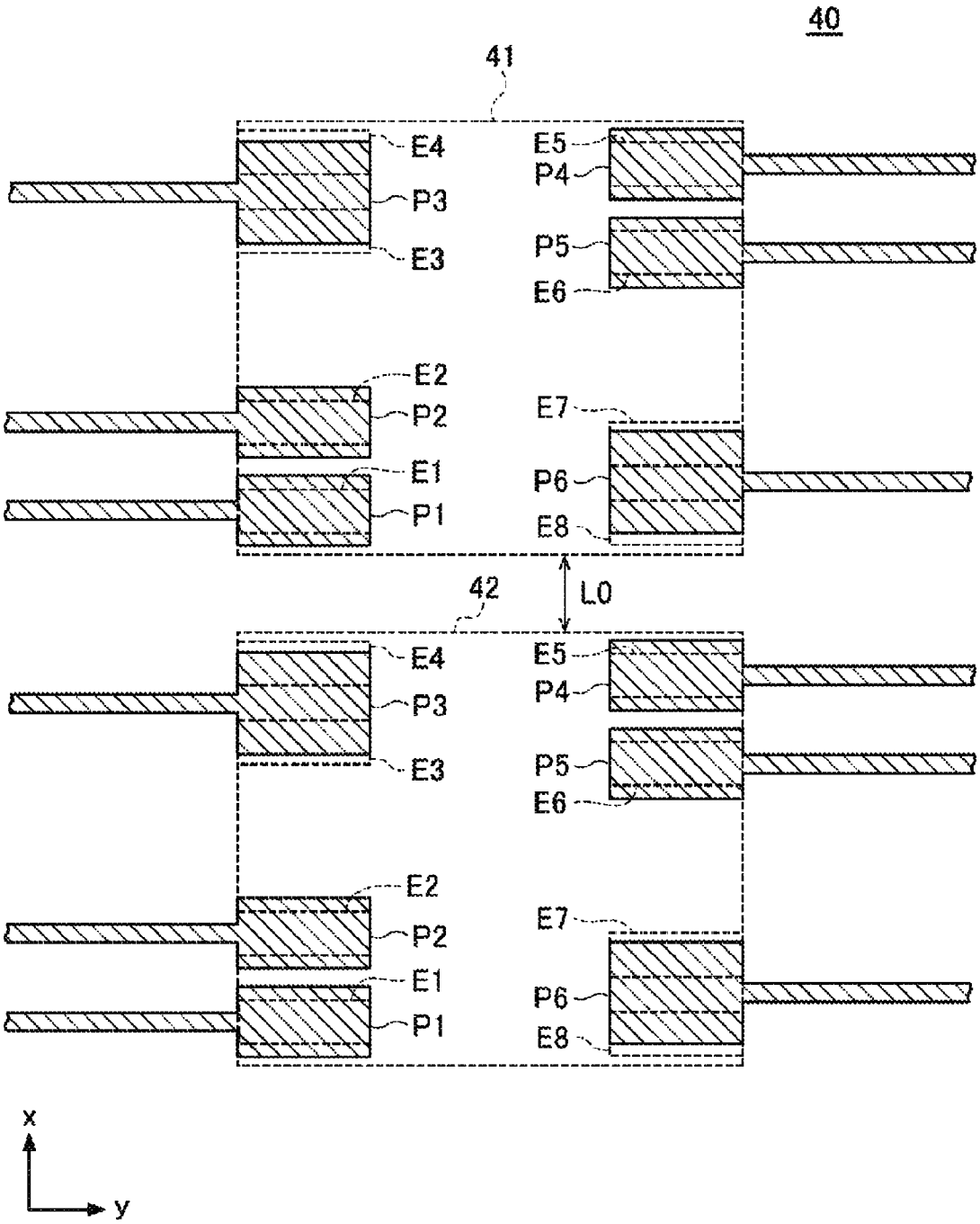
FIG. 6 is a plan view illustrating a conductor pattern on a substrate on which the coil component is mounted.

FIG. 6 is a plan view illustrating a conductor pattern on a substrate on which the coil component 10 is mounted.

In the example of FIG. 6, mounting regions 41 and 42 are assigned to a substrate 40, and two coil components 10 are mounted in the mounting regions 41 and 42. The mounting regions 41 and 42 are laid out in proximity in the x-direction to each other for high density mounting on the substrate 40. Specifically, the distance between the mounting regions 41 and 42 in the x-direction is L0. The minimum value of the distance L0 is restricted by required reliability, specification, mounting accuracy, or the like.

Figure 7:
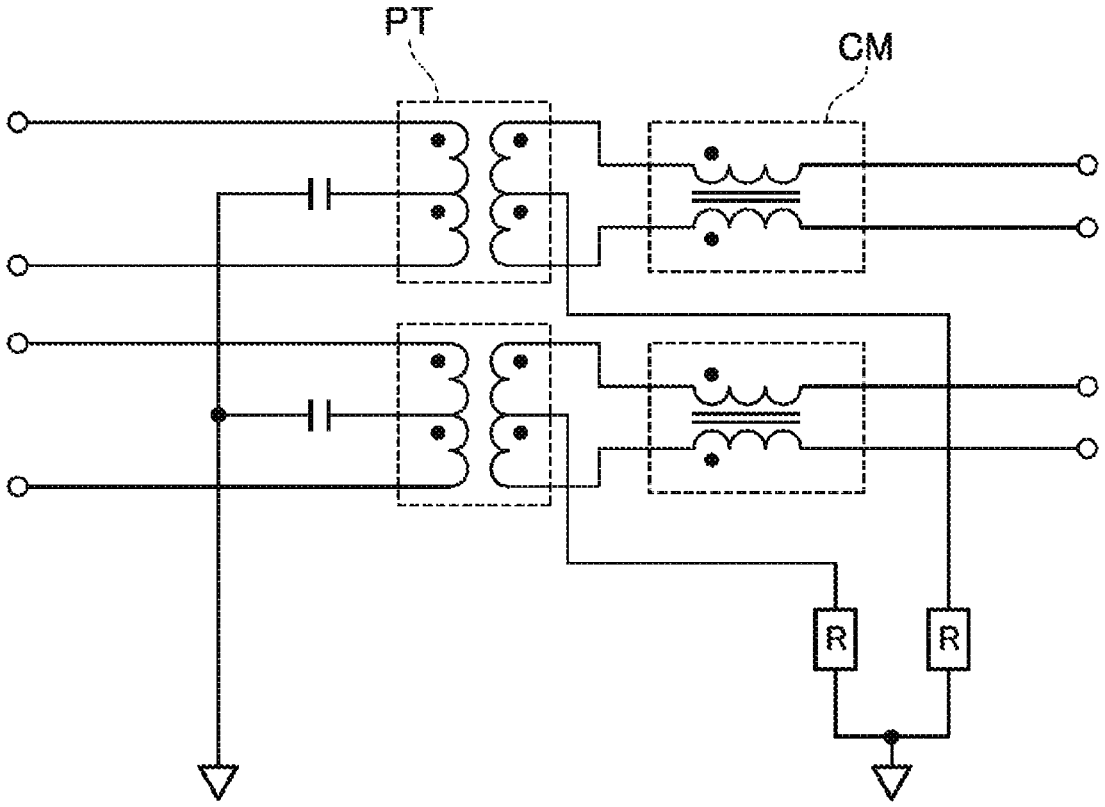
FIG. 7 is a circuit diagram of a LAN connector circuit (100 Base)
Figure 8:
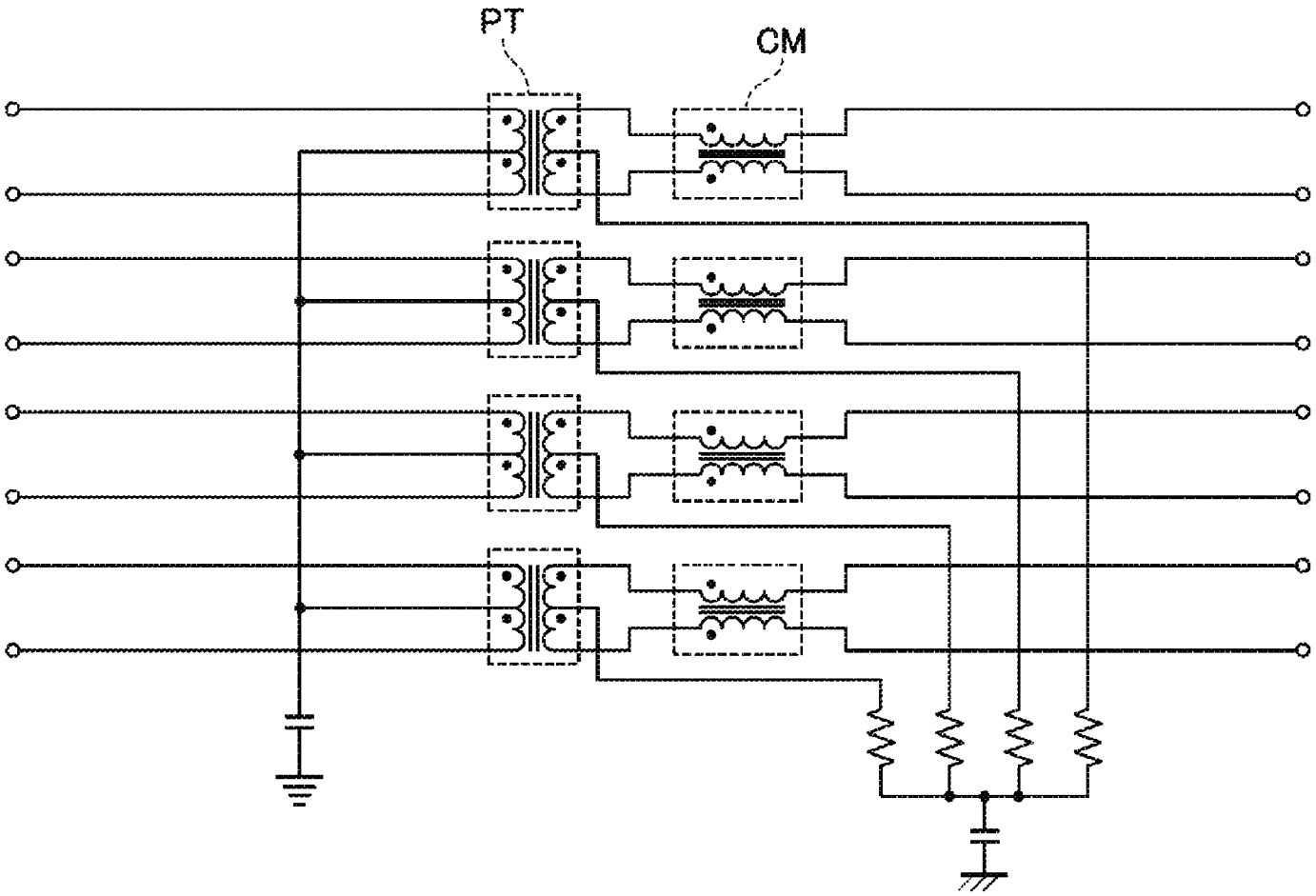
FIG. 8 is a circuit diagram of a LAN connector circuit (1000 Base)

Such a layout is required in, for example, a LAN connector circuit (100 Base) illustrated in FIG. 7 and a LAN connector circuit (1000 Base) illustrated in FIG. 8, when the coil component 10 according to the present embodiment is a pulse transformer. As illustrated in FIGS. 7 and 8, these LAN connector circuits each use a plurality of pulse transformers PT, so that when the coil components 10 are mounted at high density, the mounting regions 41 and 42 may be in proximity to each other as illustrated in FIG. 6.

Land patterns P1 to P6 to be connected to the terminal metal fittings E1 to E8 by a solder are provided on the mounting regions 41 and 42. Specifically, the land patterns P1, P2, P4, and P5 are connected respectively to the terminal metal fittings E1, E2, E5, and E6. The land pattern P3 is connected to the terminal metal fittings E3 and E4. The land pattern P6 is connected to the terminal metal fittings E7 and E8. With this configuration, the terminal metal fittings E1 and E2 can be used as a primary side input/output terminal of the pulse transformer, the terminal metal fittings E5 and E6 can be used as a secondary side input/output terminal of the pulse transformer, the terminal metal fittings E7 and E8 can be used as a primary side center tap of the pulse transformer, and the terminal metal fittings E3 and E4 can be used as a secondary side center tap.

As illustrated in FIG. 6, the width of each of the land patterns P3 and P6 in the x-direction is larger than that of each of the land patterns P1, P2, P4 and P5. This is because two terminal metal fittings (e.g., E3 and E4) are connected to one land pattern (e.g., P3). However, each of the land patterns P3 and P6 does not necessarily have to cover the whole of its corresponding two terminal metal fittings in the x-direction, and is only required to cover only a part thereof, as illustrated in FIG. 6. With this configuration, even when the distance L0 between the mounting regions 41 and 42 is small, and when the distance L6 between each of the terminal metal fittings E4 and E8 and the edge of each of the mounting regions 41 and 42 is small, it is possible to ensure the distance between the land pattern P1 provided in the mounting region 41 and the land pattern P3 provided in the mounting region 42 in the x-direction, and the distance between the land pattern P6 provided in the mounting region 41 and the land pattern P4 provided in the mounting region 42 in the x-direction.

Figure 9:
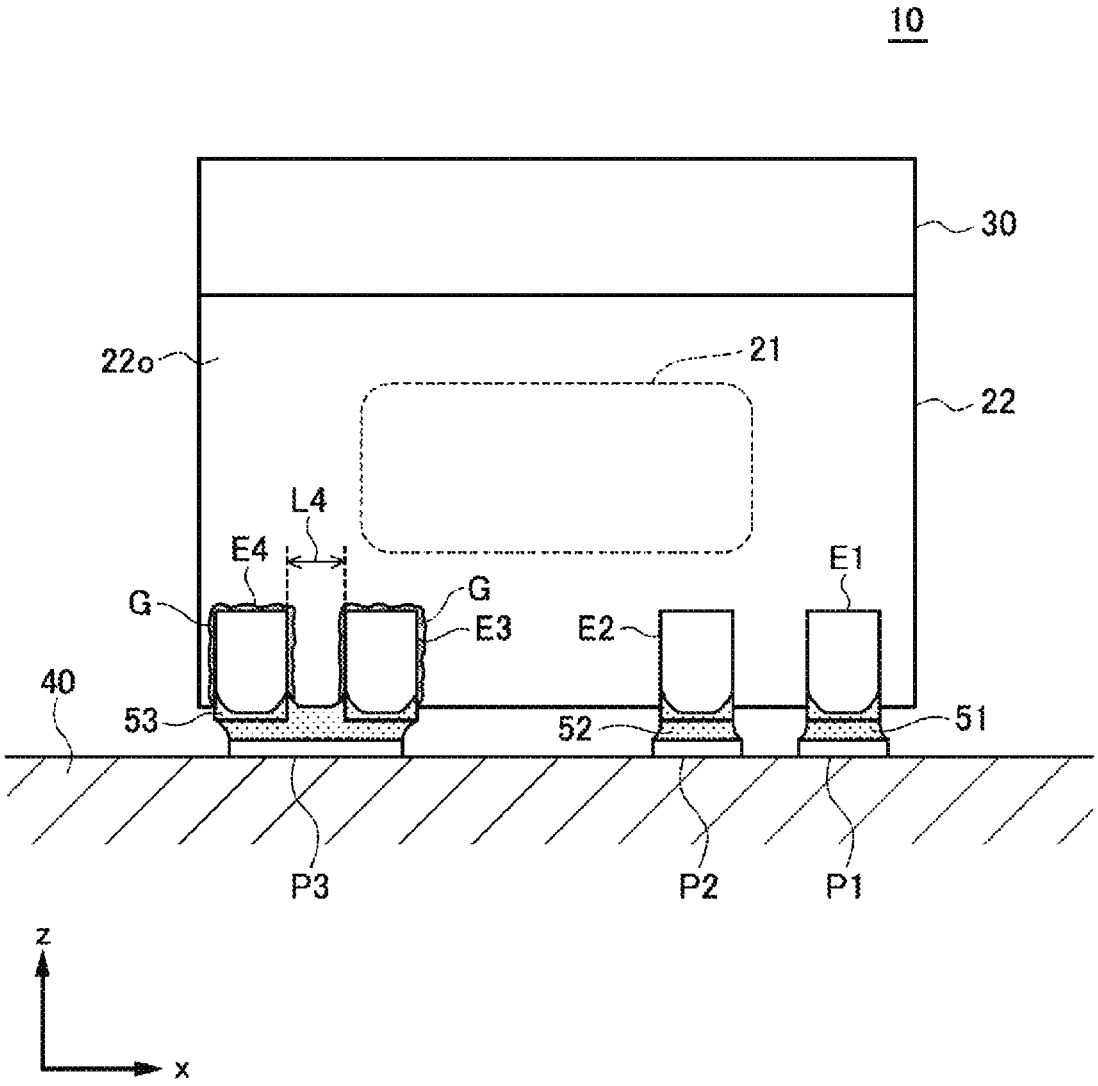
FIG. 9 is a side view of the coil component mounted on the substrate.

FIG. 9 is a side view of the coil component 10 mounted on the substrate 40.

In the example of FIG. 9, the terminal metal fitting E1 and the land pattern P1 are connected by a solder 51, the terminal metal fitting E2 and the land pattern P2 are connected by a solder 52, the terminal metal fittings E3 and E4 and the land pattern P3 are connected by a solder 53. Each of the land patterns P1 and P2 has a size larger in the x-direction than that of the corresponding one of the terminal metal fittings E1 and E2. The land pattern P3 is disposed so as to cover the interval between the terminal metal fittings E3 and E4. The solders 51 to 53 supplied respectively to the land patterns P1 to P3 cover the surfaces of the terminal metal fittings E1 to E4 that extend in the z-direction on the outer surface 22*o* of the flange part 22 to form fillets. This increases bonding strength of the coil component 10 with respect to the substrate 40, thereby increasing reliability of the circuit board.

Further, the fillet of the solder 53 forms a bridge that directly connects the terminal metal fittings E3 and E4. Such a bridge can be easily formed when the distance L4 between the terminal metal fittings E3 and E4 is small. Thus, short-circuit between the terminal metal fittings E3 and E4 is achieved not only through the land pattern P3 but through the bridge of the solder 53. Hence, the short-circuit therebetween is made more reliable.

It is apparent that the present invention is not limited to the above embodiments, but may be modified and changed without departing from the scope and spirit of the invention.

For example, the coil component 10 according to the above embodiment has the plate core 30, but it is not essential for the coil component 10 according to the present invention to have the plate core 30. Even in the case of providing the plate core 30, it is not essential for the plate core 30 to be provided on the top surfaces 22*t* and 23*t* of the respective flange parts 22 and 23, as in the case of the first embodiment, but the plate core 30 may be provided on the yz side surfaces of the respective flange parts 22 and 23 so as to connect the flange parts 22 and 23. Further alternatively, the plate core 30 may be provided on the top surfaces 22*t* and 23*t* and yz side surfaces of the respective flange parts 22 and 23. In this case, a plate core having an L-shaped cross section obtained by integrally forming a part that covers the top surfaces 22*t* and 23*t* and a part that covers the yz side surfaces may be used.

Further, it is not essential for each of the terminal metal fittings E1 to E8 to have an L-shape. For example, the terminal metal fittings E1 to E4 may be formed into a U-like shape that covers also the top surface 22*t* of the flange part 22, and the terminal metal fittings E5 to E8 may be formed into a U-like shape that covers also the top surface 23*t* of the flange part 23.

What is claimed is:

1. A coil component comprising:

a drum-shaped core including:

a winding core part, an axial direction of the winding core part being a first direction;

a first flange part provided at one end of the winding core part in the first direction; and a second flange part provided at other end of the winding core part in the first direction;

first to fourth terminal metal fittings bonded to the first flange part so as to be arranged in this order in a second direction substantially perpendicular to the first direction;

fifth to eighth terminal metal fittings bonded to the second flange part so as to be arranged in this order in the second direction; and first to fourth wires wound around the winding core part, one ends of the first to fourth wires being connected to different ones of the first to fourth terminal metal fittings and other ends of the first to fourth wires being connected to different ones of the fifth to eighth terminal metal fittings, wherein the first flange part has a first inner side surface connected to the winding core part and a first outer side surface opposite to the first inner side surface, the second flange part has a second inner side surface connected to the winding core part and a second outer side surface opposite to the second inner side surface, the first to fourth terminal metal fittings are bonded at least to the first outer side surface, the fifth to eighth terminal metal fittings are bonded at least to the second outer side surface, a distance between the first and second terminal metal fittings in the second direction is larger than the distance between the third and fourth terminal metal fittings in the second direction, a distance between the fifth and sixth terminal metal fittings in the second direction is larger than the distance between the seventh and eighth terminal metal fittings in the second direction, and an amount of an adhesive used to bond each of the third, fourth, seventh, and eighth terminal metal fittings is greater than an amount of an adhesive used to bond each of the first, second, fifth, and sixth terminal metal fittings.

2. The coil component as claimed in claim 1, wherein each of the first to eighth terminal metal fittings has a bonding surface facing the first or second flange part and a side surface substantially perpendicular to the bonding surface, and wherein the adhesive for use in bonding the third, fourth, seventh, and eighth terminal metal fittings covers at least a part of each of the side surfaces of the third, fourth, seventh, and eighth terminal metal fittings.

3. The coil component as claimed in claim 1, wherein the first flange part further has a first bottom surface substantially parallel to the first and second directions, the second flange part further has a second bottom surface substantially parallel to the first and second directions, each of the first to fourth terminal metal fittings has an L-shaped so as to cover the first outer surface and the first bottom surface, each of the fifth to eighth terminal metal fittings has an L-shaped so as to cover the second outer surface and the second bottom surface, the one end of each of the first to fourth wires contacts with each of the first to fourth terminal metal fittings on the first bottom surface, and the other end of each of the first to fourth wires contacts with each of the fifth to eighth terminal metal fittings on the second bottom surface.

4. The coil component as claimed in claim 3, further comprising a plate core, wherein the first flange part further has a first top surface opposite to the first bottom surface, the second flange part further has a second top surface opposite to the second bottom surface, and the plate core is bonded to the first and second top surfaces.

5. The coil component as claimed in claim 1, wherein the first to eighth terminal metal fittings do not overlap the winding core part as viewed in the first direction.

6. A circuit board comprising:

a substrate having a plurality of land patterns; and a coil component mounted on the substrate, wherein the coil component comprising:

a drum-shaped core including:

a winding core part, an axial direction of the winding core part being a first direction;

a first flange part provided at one end of the winding core part in the first direction; and a second flange part provided at other end of the winding core part in the first direction;

first to fourth terminal metal fittings formed on the first flange part so as to be arranged in this order in a second direction substantially perpendicular to the first direction;

fifth to eighth terminal metal fittings formed on the second flange part so as to be arranged in this order in the second direction; and first to fourth wires wound around the winding core part, one ends of the first to fourth wires being connected to different ones of the first to fourth terminal metal fittings and other ends of the first to fourth wires being connected to different ones of the fifth to eighth terminal metal fittings, wherein the first flange part has a first inner side surface connected to the winding core part and a first outer side surface opposite to the first inner side surface, the second flange part has a second inner side surface connected to the winding core part and a second outer side surface opposite to the second inner side surface, the first to fourth terminal metal fittings are bonded at least to the first outer side surface, the fifth to eighth terminal metal fittings are bonded at least to the second outer side surface, a distance between the first and second terminal metal fittings in the second direction is larger than the distance between the third and fourth terminal metal fittings in the second direction, a distance between the fifth and sixth terminal metal fittings in the second direction is larger than the distance between the seventh and eighth terminal metal fittings in the second direction, an amount of an adhesive used to bond each of the third, fourth, seventh, and eighth terminal metal fittings is greater than an amount of an adhesive used to bond each of the first, second, fifth, and sixth terminal metal fittings, the plurality of land patterns include first, second, third, and fourth land patterns connected respectively to the first, second, fifth, and sixth terminal metal fittings, a fifth land pattern connected in common to the third and fourth terminal metal fittings, and a sixth land pattern connected in common to the seventh and eighth terminal metal fittings.

7. The circuit board as claimed in claim 6, wherein the third and fourth terminal metal fittings are short-circuited by a bridge of a solder, and wherein the seventh and eighth terminal metal fittings are short-circuited by a bridge of another solder.

* * * * *